US006329962B2

(12) United States Patent
Ying

(10) Patent No.: US 6,329,962 B2
(45) **Date of Patent: *Dec. 11, 2001**

(54) MULTIPLE BAND, MULTIPLE BRANCH ANTENNA FOR MOBILE PHONE

(75) Inventor: Zhinong Ying, Lund (SE)

(73) Assignee: Telefonaktiebolaget LM Ericsson (publ), Stockholm (SE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/129,176

(22) Filed: Aug. 4, 1998

(51) Int. Cl.[7] ..... H01Q 1/36
(52) U.S. Cl. ..... 343/895; 343/700 MS; 343/702
(58) Field of Search ..... 343/700 MS, 702, 343/895; H01Q 1/36

(56) References Cited

U.S. PATENT DOCUMENTS

| | | | |
|---|---|---|---|
| 676,332 | 5/1901 | Marconi . | |
| 1,837,678 | 12/1931 | Ryder . | |
| 2,966,679 | 12/1960 | Harris | 343/895 |
| 2,993,204 | 7/1961 | Macalpine | 343/745 |
| 3,573,840 | 4/1971 | Gouillou | 343/895 |
| 4,012,744 | 3/1977 | Greiser | 343/895 |
| 4,121,218 | 10/1978 | Irwin | 343/702 |
| 4,137,534 | 1/1979 | Goodnight | 343/752 |
| 4,161,737 | 7/1979 | Albright | 343/749 |
| 4,169,267 | 9/1979 | Wong et al. | 343/895 |

(List continued on next page.)

FOREIGN PATENT DOCUMENTS

| | | | |
|---|---|---|---|
| 31 29 045 | 10/1982 | (DE) | H01Q/21/06 |
| 0 372 720 | 6/1990 | (EP) . | |
| 0 511 577 | 11/1992 | (EP) . | |
| 0 522 806 | 1/1993 | (EP) . | |
| 0 593 185 | 4/1994 | (EP) . | |
| 0 635 898 | 1/1995 | (EP) . | |
| 0 644 606 | 3/1995 | (EP) . | |
| 0 660 440 | 6/1995 | (EP) . | |
| 0 747 989 | 12/1996 | (EP) . | |
| 0 777 293 | 6/1997 | (EP) | H01Q/1/36 |

(List continued on next page.)

OTHER PUBLICATIONS

"Microwave Filters and Antennas for Personal Communication Systems" (Inverted–F Antenna For Portable Handsets), Feb. 22, 1994, Electronics Division, Professional Groups E12, Digest No. 1994/047.
"Short Sinusoidal Antennas for Wireless Communications" by M. Ali et al., 1995 IEEE, pp. 542–545.
"A Wideband Dual Meander Sleeve Antenna" by M. Ali et al., 1995 IEEE, pp. 1124–1127.
Patent Abstracts of Japan, JP–0236602, Sep. 30, 1994.
"Antennas" by J.D. Kraus, (McGraw–Hill Book Co., Inc.) pp. 173–178 (1950).
"Microwave Scanning Antennas" edited by R.C. Hansen, Peninsula Publishing, pp. 116–122 (1950).

*Primary Examiner*—Don Wong
*Assistant Examiner*—Shih-Chao Chen
(74) *Attorney, Agent, or Firm*—Burns, Doane, Swecker & Mathis, L.L.P.

(57) ABSTRACT

A multiple band antenna having multiple branches, each branch having a length and geometry selected to resonate in a particular frequency band. Each branch can be formed by a flexible film which has a meandering, outer spiral or inner spiral strip line pattern formed thereon and which is formed into a desired shape. Each branch can also be formed by etching a strip line to a member of a desired shape. The strip line pattern is preferably formed by printing so as to avoid mechanical tolerance problems.

18 Claims, 3 Drawing Sheets

U.S. PATENT DOCUMENTS

| | | | | |
|---|---|---|---|---|
| 4,229,743 | | 10/1980 | Vo et al. | 343/749 |
| 4,356,492 | | 10/1982 | Kaloi | 343/700 |
| 4,571,595 | | 2/1986 | Phillips et al. | 343/745 |
| 4,723,305 | | 2/1988 | Phillips et al. | 455/89 |
| 4,742,359 | | 5/1988 | Ishino et al. | 343/895 |
| 4,860,020 | | 8/1989 | Wong et al. | 343/828 |
| 4,868,576 | | 9/1989 | Johnson, Jr. | 343/702 |
| 5,020,093 | | 5/1991 | Pireh | 379/59 |
| 5,204,687 | | 4/1993 | Elliott et al. | 343/702 |
| 5,216,436 | | 6/1993 | Hall et al. | 343/895 |
| 5,255,005 | * | 10/1993 | Terret et al. | 343/895 |
| 5,298,910 | | 3/1994 | Takei et al. | 343/895 |
| 5,311,201 | | 5/1994 | Lillie et al. | 343/791 |
| 5,317,325 | | 5/1994 | Bottomley | 343/702 |
| 5,353,036 | | 10/1994 | Baldry | 343/702 |
| 5,363,114 | | 11/1994 | Shoemaker | 343/828 |
| 5,386,203 | | 1/1995 | Ishihara | 333/129 |
| 5,436,633 | | 7/1995 | Liu | 343/723 |
| 5,438,339 | | 8/1995 | Itoh et al. | 343/702 |
| 5,446,469 | | 8/1995 | Makino | 343/702 |
| 5,451,974 | | 9/1995 | Marino | 343/895 |
| 5,467,096 | | 11/1995 | Takamoro et al. | 343/702 |
| 5,471,221 | | 11/1995 | Nalbandian et al. | 343/700 |
| 5,479,178 | | 12/1995 | Ha | 343/702 |
| 5,532,703 | | 7/1996 | Stephens et al. | 343/702 |
| 5,546,094 | | 8/1996 | Egashira | 343/702 |
| 5,548,827 | | 8/1996 | Hanawa et al. | 455/129 |
| 5,550,820 | | 8/1996 | Baran | 370/60.1 |
| 5,594,457 | | 1/1997 | Wingo | 343/702 |
| 5,612,704 | | 3/1997 | Cole | 343/702 |
| 5,621,422 | * | 4/1997 | Wang | 343/895 |
| 5,635,943 | | 6/1997 | Grunwell | 343/702 |
| 5,661,496 | | 8/1997 | Baek et al. | 343/702 |
| 5,709,832 | * | 1/1998 | Hayes et al. | 264/272.11 |
| 5,828,342 | * | 10/1998 | Hayes et al. | 343/702 |
| 5,838,285 | * | 11/1998 | Tay et al. | 343/895 |
| 5,903,240 | * | 5/1999 | Kawahata et al. | 343/700 MS |
| 5,936,594 | * | 8/1999 | Yu et al. | 343/895 |
| 5,986,609 | * | 11/1999 | Spall | 343/702 |
| 5,990,847 | * | 11/1999 | Filipovic et al. | 343/895 |
| 5,990,849 | * | 11/1999 | Salvail et al. | 343/895 |
| 6,069,592 | | 5/2000 | Wass | 343/895 |
| 6,166,694 | * | 12/2000 | Ying | 343/702 |

FOREIGN PATENT DOCUMENTS

| | | | |
|---|---|---|---|
| 0 855 759 | 7/1998 | (EP) . | |
| 2 664 749 | 1/1992 | (FR) | H01Q/13/10 |
| 2175748 | 12/1986 | (GB) . | |
| 63-219204 | 9/1988 | (JP) | H01Q/21/00 |
| 6-37531 | 2/1994 | (JP) | H01Q/11/08 |
| 6-90108 | 3/1994 | (JP) | H01Q/9/26 |
| 6-152221 | 5/1994 | (JP) | H01Q/1/50 |
| H10-173430 | 6/1998 | (JP) . | |
| WO93/12559 | 6/1993 | (WO) . | |
| WO94/21003 | 9/1994 | (WO) . | |
| WO96/27219 | 9/1996 | (WO) . | |
| WO96/38882 | 12/1996 | (WO) . | |
| WO97/11507 | 3/1997 | (WO) . | |
| WO 97/49141 | 12/1997 | (WO) | H01Q/1/36 |

* cited by examiner

MULTIPLE BAND, MULTIPLE BRANCH ANTENNA FOR MOBILE PHONE

This application is related to U.S. patent application Ser. No. 08/958,846, filed Oct. 28, 1997, the disclosure of which is incorporated herein by reference.

FIELD OF THE INVENTION

The present invention relates generally to antennas for mobile communication devices. More particularly, the present invention relates to a multiple band, multiple branch antenna.

BACKGROUND OF THE INVENTION

Because there are many different types of communication systems, such as GSM, DCS, PCS, DAMPS, and others, it is increasingly possible to have different types of systems serving a common area. These systems typically operate at different frequency ranges, e.g., GSM typically operates at 890–960 MHz and DCS typically operates at 1710–1880 MHz. In the future, it may be desirable to introduce any of a number of functions such as home based wireless phone, mini data link, wireless hands free set, etc. to a mobile telephone. For these reasons, a multiple mode antenna (that is, an antenna which can resonate at different frequencies to allow a communication device to operate in multiple bands) is highly desirable.

Some dual band antenna designs are known. The Japanese patent (6-37531) discloses a helix which contains an inner parasitic metal rod. In this antenna, the antenna can be tuned to dual resonant frequencies by adjusting the position of the metal rod. Unfortunately, the bandwidth for this design is too narrow for use in cellular communications. Dual band printed monopole antennas are known in which dual resonance is achieve by the addition of a parasitic strip in close proximity to a printed monopole antenna. While such an antenna has enough bandwidth for cellular communication, it requires the addition of a parasitic strip. Moteco AB in Sweden has designed a coil matching dual band whip antenna and coil antenna, in which dual resonance is achieved by adjusting the coil matching component (¼λ for 900 MHz and ½λ for 1800 MHz). While this antenna has relatively good bandwidth and radiation performances, its length is only about 40 mm. A non-uniform helical dual band antenna which is relatively small in size is disclosed in Applicant's copending, commonly assigned U.S. patent application Ser. No. 08/725,507, entitled "Multiple Band Non-Uniform Helical Antennas", the entirety of which is incorporated herein by reference.

Typical dual band extendable whip antennas, such as those mentioned above, require a complicated matching network to match the whip antenna impedance to the two bands within 50 ohms. A dual band retractable antenna is disclosed in Applicant's copending, commonly assigned U.S. patent application Ser. No. 08/725,504, entitled "Retractable Multi-Band Antennas", the entirety of which is incorporated herein by reference. Such an antenna includes two ports, one for a helical antenna and another for a whip antenna and a device for switching therebetween.

It would be desirable for a multiple mode portable communication device to have an efficient multiple band antenna. Conventional dual band helical antennas such as those described above have certain disadvantages. For example, mechanical production tolerances can change the resonant frequencies, particularly at higher bands. Also, it can be relatively difficult to provide a sufficient coupling for dual band parasitic coupling extendable antennas because the distance between a base antenna and the extendable whip can be different at different bands.

SUMMARY OF THE INVENTION

The present invention overcomes the above-described problems, and achieves additional advantages, by providing a multiple band, multiple branch antenna which can be tuned to multiple resonant frequencies. The multiple resonances for the antenna (corresponding to, for example, GSM, DCS or PCS bands) are achieved by providing variations in the printed pattern of the antenna branches. Each branch of the antenna can be printed on a relatively thin plastic film, and can be rolled into a cylindrical shape. Alternatively, the branches can be formed by etching patterns on a plastic member having a cylindrical or other suitable shape.

The multiple branch antenna of the present invention achieves resonance at different frequencies without a matching network. If the antenna branches are formed by printing, mechanical tolerance problems are avoided. The geometries of the branches can be varied to allow increased design freedom.

BRIEF DESCRIPTION OF THE DRAWINGS

The features and advantages of the present invention will be more fully understood upon reading the following Detailed Description of the Preferred Embodiments in conjunction with the accompanying drawings, in which like reference indicia designate like elements, and in which:

FIG. 2(*b*) is a diagram of a printed antenna branch having an outer spiral branch strip pattern according to an embodiment of the present invention:

FIG. 2(*c*) is a diagram of a printed antenna branch having an inner spiral branch strip pattern according to an embodiment of the present invention;

DETAILED DESCRIPTION OF THE PREFERRED EMBODIMENTS

Figure 1:
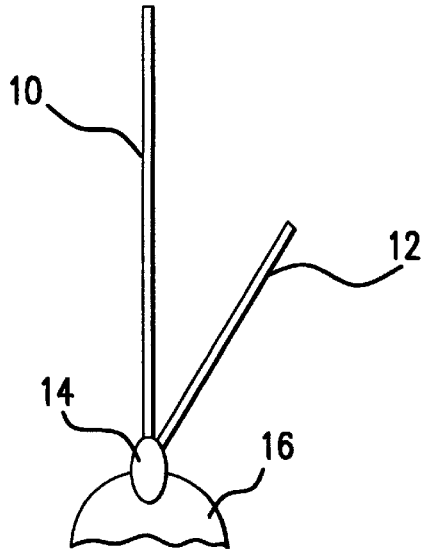
FIG. 1 is a diagram showing a multiple branch antenna implementing the principles of the present invention.

A central principle of the present invention is that different branches of the multiple band antenna are resonant at different frequencies. This principle is represented in FIG. 1, which shows a Multiple branch antenna having first and second branches 10 and 12. The antenna branches are connected to a common port 14 for exchanging signals between the antenna branches and the transceiver circuitry of a portable communications device 16. The first branch 10 is of a length and construction so as to be resonant at frequencies in a first band, and the second branch 12 is of a length and construction so as to be resonant at frequencies in a second band. According to a preferred embodiment of the present invention, the first band is the GSM band and the second band is the DCS band. In such an embodiment, the first branch 10 is approximately ¼ wavelength of a GSM signal, and the second branch 12 is approximately ¼ wavelength of a DCS signal. The antenna is tuned, for example at the time of manufacture, to an impedance of approximately 50 Ω for both bands. If the antenna is so tuned, no impedance matching circuitry is required between the antenna and the port 14.

While the present embodiment sets forth that the first and second bands are GSM and DCS bands, respectively, one skilled in the art will appreciate that other combinations of frequency bands may be implemented without departing from the spirit and scope of the present invention. For example, other possible combinations of low and high bands could include GSM+PCS, GSM+WCDMA, DCS+WCDMA, GSM+GPS, GSM+ISM, or any other combination of lower and higher frequency bands.

Figure 2A:
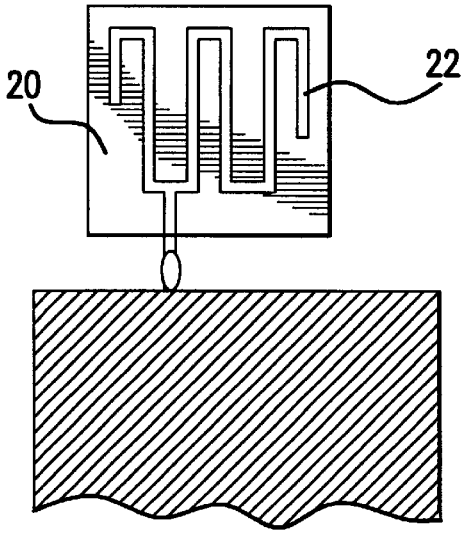
FIG. 2(*a*) is a diagram of a printed antenna branch having a meandering branch strip pattern according to an embodiment of the present invention.
Figure 3:
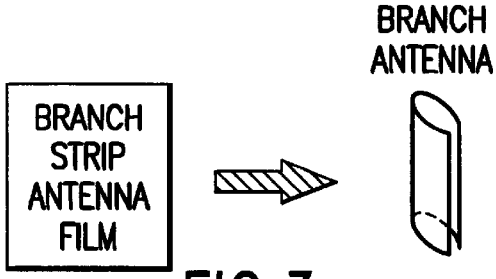
FIG. 3 is a diagram showing a method for manufacturing an antenna according to the present invention.
Figure 2B:
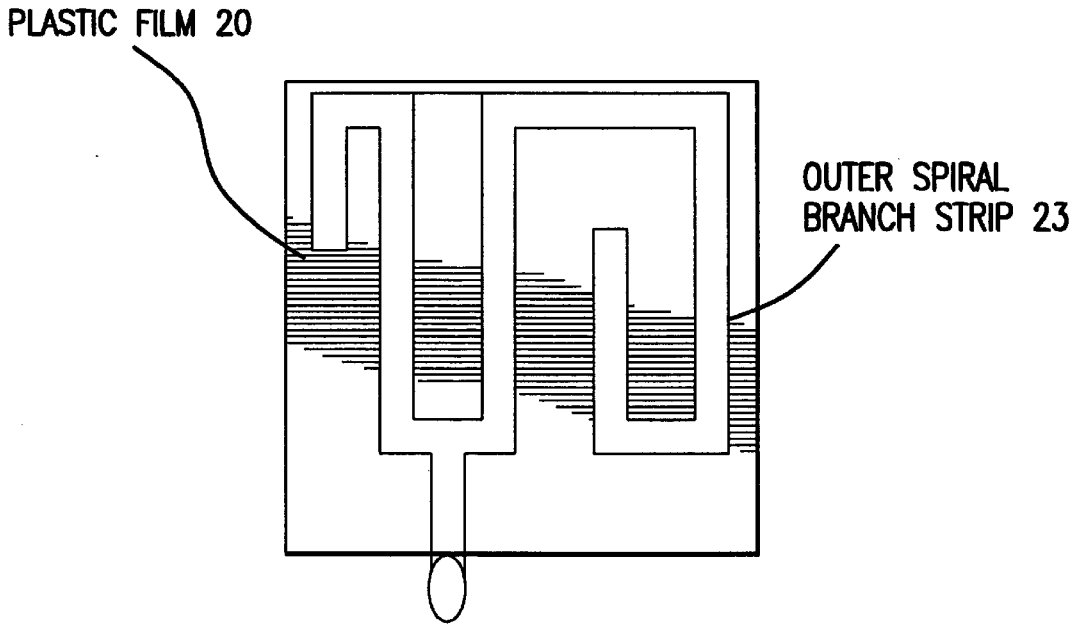
Figure 2C:
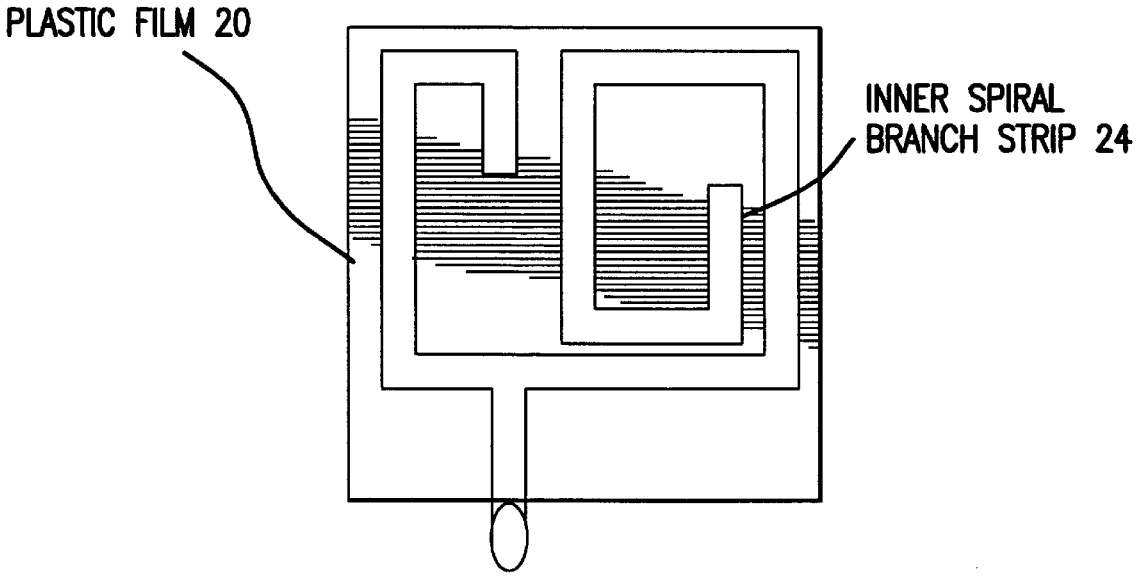

Referring now to FIGS. 2(*a*)–(*c*), exemplary embodiments of the present invention are illustrated. In FIG. 2(*a*), the antenna branch is comprised of a relatively thin, flexible dielectric film 20 and a strip antenna formed by a meandering metal line 22. The metal line can be formed by printing, etching, or any other suitable method. Because the film is a flexible material, the printed film can be rolled into a generally cylindrical shape for use as an antenna branch, as shown in FIG. 3. It should be appreciated that the cylinder could be partially open or completely closed depending upon antenna design considerations. For example, the bandwidth of the antenna can be varied by varying the diameter of the cylinder. Of course, it should be appreciated that the antenna branches can be formed in shapes other than a cylinder, and different branches can have different geometries (for example, elliptical), depending upon design considerations. The metal line 22 can also be etched directly onto a dielectric cylinder. The use of different geometries and manufacturing methods allow for increased design freedom.

The meandering metal line 22 is preferably varied between the antenna branches such that the different antenna branches are resonant at different frequencies. Thus, multiple resonances in multiple branches can be achieved by selecting appropriate strip dimensions and patterns for each branch.

It will be appreciated by one skilled in the art that a variety of different patterns for the metal strips could be selected in order to achieve the desired resonances. FIGS. 2(*b*) and (*c*) illustrate two such alternative patterns. In FIG. 2(*b*), the strip antenna is formed by an outer spiral metal line 23. As with the meandering metal line 22, the outer spiral metal line 23 is preferably varied between the antenna branches such that the different antenna branches are resonant at different frequencies. As an alternative to the outer spiral pattern illustrated in FIG. 2(*b*), the strip antenna may be formed by an inner spiral metal line 24 as is illustrated in FIG. 2(*c*).

While the set of metal lines illustrated in FIGS. 2(*a*)–(*c*) are both either meandering, outer spiral or inner spiral in shape, one skilled in the art will appreciate that a combination of shapes may also be employed. For example, one of the metal lines may be of a meandering shape while the other is of an inner or outer spiral shape.

The selection of a particular shape depends on antenna design considerations. For example, where less interference from the chassis is desirable, the outer spiral shape should be selected. Similarly, where it is desirable for the coupling between the lower and higher bands to be more separated, the inner spiral shape should be selected.

The antenna branches are similar to monopole antennas, and have relatively high efficiency when used in a portable, hand-held communication device such as a mobile telephone. The dual resonances of a typical dual band helical antenna are achieved by changing pitch angle or other helical parameters. Because the resonant frequencies in a helical antenna will also be dependent upon the mechanical tolerances of the helical parameters, the multiple branch antenna of the present invention provides a significant advantage. More particularly, the printed multiple branch antenna according to the present invention significantly reduces the likelihood of mechanical tolerance problems because the height of the antenna can be easily adjusted by changing the strip line pattern or dimensions.

The antenna of the present invention is particularly suitable as a multiple mode base antenna for the parasitic extendable dual band antenna disclosed in Applicant's copending, commonly-assigned U.S. patent application Ser. No. 08/958,842, entitled "Multiple Band Telescope Type Antenna for Mobile Phone", the entirety of which is incorporated herein by reference. When used as a base antenna in cooperation with a whip antenna, the multiple mode, multiple branch antenna of the present invention allows the coupling distance between whip antenna and the base antenna to be easily adjusted. This provides a significant advantage over known dual band helical antennas.

Figure 4:
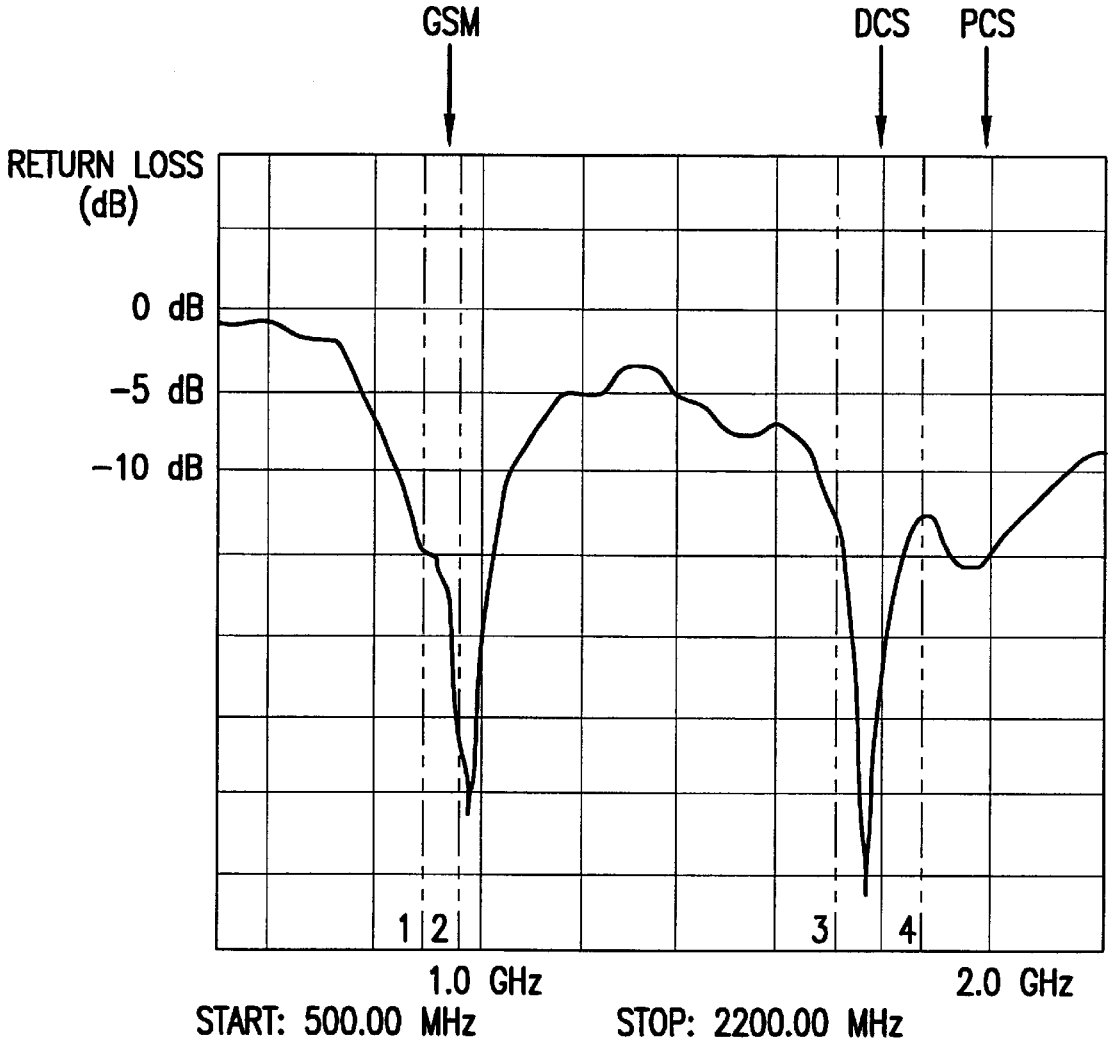
FIG. 4 is a graphical representation of measured return loss for an antenna assembly including a multiple branch antenna according to the invention.

Referring now to FIG. 4, a graphical representation of measured return loss for an antenna assembly including a multiple band, multiple branch antenna according to the present invention is shown. In this example, the plastic film is bent into a substantially circular cylinder which is approximately 25 mm in length and approximately 9 mm in diameter. FIG. 4 shows the return loss in dB for different frequencies. The diagram indicates a first peak corresponding to the GSM frequency band, a second peak corresponding to the DCS frequency band, and a third, shallower peak corresponding to the PCS frequency band. It will be appreciated that a suitable antenna according to the present invention can be designed to operate in two or more bands corresponding to GSM, DCS, PCS, or other frequency bands. Radiation pattern tests of the antenna according to the present invention show that the antenna achieves performance similar to a helical antenna, but with a broader bandwidth.

While the foregoing description includes numerous details which are provided for instructional and explanatory purposes only. The specific examples discussed above are not to be construed as suggesting limitations of the invention; rather, these examples can be modified in many ways without departing from the scope of the invention, as defined by the following claims and their legal equivalents.

What is claimed is:

1. A multiple band, branch antenna comprising:

a plurality of metal strips; and a dielectric member;

wherein said plurality of metal strips are formed on said dielectric member in a pattern; and wherein lengths of said metal strips are selected so as to allow said multiple band branch antenna to be tuned to multiple resonances, and wherein said metal strips are connected to each other at a common port and wherein the pattern of at least one of the metal strips is a spiral line pattern.

2. The multiple band, branch antenna of claim 1 wherein said spiral line pattern is an outer spiral line pattern.

3. The multiple band, branch antenna of claim 1 wherein said spiral line pattern is an inner spiral line pattern.

4. The multiple band, branch antenna of claim 1 wherein said plurality of metal strips are formed by printing.

5. The multiple band, branch antenna of claim 1 wherein said plurality of metal strips are formed by etching.

6. The multiple band, branch antenna of claim 1 wherein said dielectric member is a flexible dielectric film.

7. The multiple band, branch antenna of claim 6 wherein said flexible dielectric film is rolled into a cylindrical shape.

8. The multiple band, branch antenna of claim 1 wherein said dielectric member is a dielectric cylinder.

9. The multiple band branch antenna of claim 1, wherein the metal strips are one of a first metal strip and a second metal strip, where the first metal strip resonates at frequencies in a first band and the second metal strip resonates at frequencies in a second band.

10. A multiple band, branch antenna comprising:

a plurality of metal strips, each formed in a pattern and having a length; and a dielectric member onto which said plurality of metal strips are formed;

wherein said length of each metal strip is selected so as to obtain a desired resonant frequency, and wherein said metal strips are connected together at a port and wherein the pattern of at least one of the metal strips is a spiral line pattern.

11. The multiple band, branch antenna of claim 10 wherein said pattern is selected so as to allow the multiple band, branch antenna to be tuned to multiple resonances.

12. The multiple band, branch antenna of claim 10 wherein said spiral line pattern is an outer spiral line pattern.

13. The multiple band, branch antenna of claim 10 wherein said spiral line pattern is an inner spiral line pattern.

14. The multiple band, branch antenna of claim 10 wherein said plurality of metal strips are formed on said dielectric member by printing.

15. The multiple band, branch of claim 10 wherein said plurality of metal strips are formed on said dielectric member by etching.

16. The multiple band, branch antenna of claim 10 wherein said dielectric member is a flexible dielectric film.

17. The multiple band, branch antenna of claim 16 wherein said flexible dielectric film is rolled into a cylindrical shape.

18. The multiple band, branch antenna of claim 10 wherein said dielectric member is a dielectric cylinder.

* * * * *